United States Patent [19]

Nowak et al.

[11] 4,318,705

[45] Mar. 9, 1982

[54] PROCESS FOR IMPROVING THE LIGHTFASTNESS OF CONVENTIONALLY DYED LEATHER

[75] Inventors: Rudolf Nowak, Krefeld; Kurt Dahmen, Monchen-Gladbach; Dolf Stockhausen, Krefeld, all of Fed. Rep. of Germany

[73] Assignee: Chemische Fabrik, Cologne, Fed. Rep. of Germany

[21] Appl. No.: 73,172

[22] Filed: Sep. 6, 1979

[30] Foreign Application Priority Data

Sep. 8, 1978 [DE] Fed. Rep. of Germany ..... 2839129

[51] Int. Cl.[3] ..... D06P 3/32

[52] U.S. Cl. ..... 8/436; 8/437; 8/94.23; 8/94.22

[58] Field of Search ..... 8/12, 94.23, 436

[56] References Cited

U.S. PATENT DOCUMENTS 2,334,186 11/1943 Fox ..... 260/30.8 R

FOREIGN PATENT DOCUMENTS 1151346 7/1963 Fed. Rep. of Germany ..... 8/94.23
866256 7/1941 France .
878971 2/1943 France .
298565 8/1929 United Kingdom ..... 8/12

*Primary Examiner*—Maria Parrish Tungol
*Attorney, Agent, or Firm*—Sprung, Felfe, Horn, Lynch & Kramer

[57] ABSTRACT

The invention relates to a process for improving the lightfastness of conventionally dyed leathers by treating the leathers before, during or after fatting with alkane and/or chloroalkane sulfonamides in amounts of about 0.1 to 8 weight percent, based on the shaved weight of the leather. Used as alkane sulfonamides and chloroalkane sulfonamides are preferably products with a chain length of about 10 to 35 carbon atoms and a chlorine content of about 10 to 40%. The alkane and/or chloroalkane sulfonamides are advantageously used in aqueous solution or in stable emulsion. A substantial improvement in lightfastness is obtained regardless of the type of the dye, tanning agent, fatting agent or other leather treating agent used.

9 Claims, No Drawings

PROCESS FOR IMPROVING THE LIGHTFASTNESS OF CONVENTIONALLY DYED LEATHER

BACKGROUND OF THE INVENTION

The invention relates to a process for improving the lightfastness of dyed leathers by the use of alkane or chloroalkane sulfonamides.

Leather is dyed mainly by means of selected acid, substantive and metal-complex dyes and, to a minor extent, basic dyes. In the case of unfinished or just lightly finished leather, the lightfastness of the dye-leather union is a primary criterion of quality. This is so because when a dyed leather is exposed to light, what is measured is the fastness, not of the dyes used but of the dye-leather union.

For this reason, the lightfastness of identical dyes on leather usually is very much inferior to that on textile fibers. The lightfastness of dyes on leather depends in some measure on their structure and on the auxiliary materials used in the manufacture of the leather, such as tanning agents, lubricants, dyeing assistants, etc. (F. Grall and H. Gardere, "Betrachtungen über die Lichtechtheit des gefärbten Leders" (Reflections on the lightfastness of dyed leather), a paper presented at the 15th IULTCS Congress, Hamburg, 1977; Das Leder 1978, 6, pp. 94 to 98.)

To achieve very good lightfastness, which on leather ranges from 4 to 5, measured in conformity with DIN 54 004, it is by no means enough to use only dyes, tanning agents and lubricants which are stable to light since unpredictable interactions may have a favorable or adverse effect on the lightfastness of the dye-leather union.

The fatliquoring agents used in the particular fatting operation have a decisive effect on the lightfastness of dyed leathers. They influence not only the hue, its depth, brilliance and uniformity, but also the lightfastness of the color imparted. With exacting requirements, so-called "non-yellowing fatliquoring agents" based on sperm oil, neatsfoot oil, synthetic triolein and similar raw materials are therefore used. Synthetic fatting agents based on alkane and chloroalkane sulfonates are regarded as possessing particularly good stability to light. (German patent applications DAS Nos. 1,142,833 and 1,494,828.)

However, for the reasons stated, the desired high lightfastness of the dyed leather, which has a decisive effect on the utility value of leather used in clothing or furniture, of aniline upper leather and suede, etc., is not or not fully achieved regardless of how carefully the auxiliary materials are selected. This is true also when the synthetic fatting agents mentioned are used.

French Pat. No. 866,256 and German Pat. No. 864,905 describe the preparation of sulfonamides by the reaction of chlorine and sulfur dioxide with saturated aliphatic hydrocarbons followed by reaction of the sulfohalides obtained with ammonia or primary and secondary amines. The sulfonamides obtained by this route are suited for use as oiling and fatting agents for materials of fibrous structure and also as lubricants for machinery. It is pointed out that sulfonamides are suited for the fatting and fatliquoring of leather, among other things.

In German Pat. No. 747,403 it is stated that emulsifiers which dissolve clear in mineral oils and fatty oils and exhibit improved effectiveness over long-chain paraffin sulfonates are obtained when these sulfonates are used jointly with sulfonamides, sulfoacylamides or disulfimides prepared by sulfochlorination of long-chain paraffin hydrocarbons followed by treatment with ammonia or its organic derivatives. The clear mixtures of the oils and these emulsifiers are water-soluble and are said to be suitable for use as drilling oils, leather stuffing materials, lubricating and cutting oils.

The use of sulfamides, sulfonamides or sulfimides such as obtained in the reaction of alkane sulfohalides with ammonia or its derivatives, in the fatting of leather in the amounts customary in leather fatting which, depending on the type of the leather and on the composition of the fatting agent, range approximately from 10 to 15 weight percent, based on the shaved weight of the leather, is then described. However, nowhere in the art of record are there any statements to the effect that such products have an effect on the lightfastness of dyed leather, and have such an effect even when used in small amounts.

Because of their insufficient solubility in water, these products cannot, however, be used alone in fatliquoring but must be combined for this purpose with other fatting agents or emulsifiers which assure that the overall combination of the fatting agent is soluble in water or at least gives an emulsion that is sufficiently stable in water.

SUMMARY OF THE INVENTION

It is the object of the invention to permanently improve the lightfastness of conventionally dyed leathers by simple yet effective means without the leather having to be subjected to a complicated separate treatment before, during or after dying, the improvement in lightfastness being achieved regardless of the type of dye, tanning agent, fatting agent or other leather dressing agent used and even when the leathers have been treated with fatting agents or other dressing agents which are not stable to light.

In accordance with the invention, this object is accomplished by treating the dyed leathers with alkane and/or chloroalkane sulfonamides.

The ability of these alkane and/or chloroalkane sulfonamides to markedly improve the lightfastness of the dyeleather union even when used in small amounts is surprising, especially since a pronounced improvement in lightfastness is observable also when the leather has been treated with auxiliary agents which are not stable to light, such as yellowed fatting agents, for example, sulfated fish oil.

The invention thus has as its object a process for improving the lightfastness of conventionally dyed leathers that is characterized in that the leathers are treated with alkane and/or chloralkane sulfonamides. The latter are used in amounts ranging from about 0.1 to 8 weight percent, and more particularly 0.3 to 6.0 weight percent, and preferably 0.5 to 2.5 weight percent, based on the shaved weight of the leather. Good results will be obtained with amounts of up to 4 or even 3 weight percent.

The treatment is preferably carried out together with the fatting, and more particularly the fatliquoring, in order to save an extra process step. However, the treatment may also be effected in a separate step before or after dyeing and fatting. Based on the total amount of fat used (the "total fat"), the proportion of the sulfonamides and/or chlorosulfonamides is between 0.2 and 50 weight percent, and more particularly between 0.5 and 40 weight percent, up to about 15% of fatting agent being generally used. However, the minimum amount is about 0.1 weight percent, based on the shaved weight of the leather. Good results will be obtained with for example a proportion of 17% sulfonamide and/or chlorosulfonamide, based on the total amount of fat.

The sulfonamides or alkanes or chloroalkanes having a chain length of about 10 to 30, and preferably 12 to 25, carbon atoms have proved best suited for the purposes of the invention. The chloroalkane sulfonamides preferably have a degree of chlorination ranging from 10 to 40 weight percent, and preferably from 15 to 30 weight percent, chlorine, based on the particular hydrocarbon. The alkanes on which the sulfonamides are based are predominantly straight-chain and thus are formed almost exclusively of n-paraffin, and have but a small content of branched isomers, usually due to the manufacturing process.

Depending on the manufacturing process, the alkane or chloroalkane sulfonamides may contain the corresponding sulfimides, apart from small amounts of sulfonic acid salts, the proportion of which is largely determined by the manufacturing process and by the manner in which the product is worked up.

When the alkane sulfonamides employed in accordance with the invention are used in fatliquoring, they are combined with fatting agents of varying composition which are either soluble in water or emulsifiable in water.

The alkane or chloroalkane sulfonamides are prepared by procedures patterned on methods known from the literature, paraffin sulfochlorides obtained by the sulfochlorination of paraffin or chloroparaffin being reacted with ammonia or primary and/or secondary amines:

F. Ansinger, Chemie and Technologie der Paraffin-Kohlenwasserstoffe (Chemistry and technology of paraffin hydrocarbons), Akademie-Verlag, Berlin, 1959, p. 465 et seq.;

FIAT Final Report No. 1141: Synthetic Detergents and Related Surface-Active Agents in Germany, by J. D. Brandner, W. H. Lockwood, R. H. Nagel and K. L. Russel, pp. 47 and 68;

U.S. Pat. No. 2,334,186;

French Pat. No. 878,971.

The amidation may be carried out with liquid, gaseous or aqueous ammonia or its organic derivatives.

Under industrial conditions, only partial sulfochlorination of the alkanes or chloroalkanes is usually effected. This is why the paraffin sulfochlorides or chloroparaffin sulfochlorides used as starting material contain a substantial proportion of neutral oil which remains in the resulting sulfonamides even when no special working-up and separating operations, such as extractions or distillations, are carried out.

The raw materials used in sulfochlorination and amidation in the examples which follow conform to the following specifications:

| Chloroparaffin: | |
|---|---|
| Chlorine content: | 19.4% |
| Specific gravity: | 0.907 |
| Index of refraction: | 1.4650 |
| Pour point: | 15° C. |

The product was obtained by chlorination of a paraffin having the following characteristics:

| | |
|---|---|
| n-Paraffin content: | About 94% |
| Isomers: | About 6% |
| Average molecular weight: | 304 |

| | |
|---|---|
| C 16 | 0.1% |
| C 17 | 1.2% |
| C 18 | 5.6% |
| C 19 | 12.2% |
| C 20 | 15.1% |
| C 21 | 14.6% |
| C 22 | 12.8% |
| C 23 | 11.1% |
| C 24 | 9.3% |
| C 26 | 5.3% |
| C 27 | 3.1% |
| C 28 | 1.4% |
| C 29 | 0.6% |
| C 30 | 0.2% |
| C 31 | 0.1% |
| C 32 | 0.1% |

| Paraffin: | |
|---|---|
| n-Paraffin content: | 98% min. |
| Isomers: | 2% max. |
| Average molecular weight: | 213 |

| | |
|---|---|
| C 10 | 1% |
| C 11 | 3% |
| C 12 | 4% |
| C 13 | 6% |
| C 14 | 23% |
| C 15 | 25% |
| C 16 | 22% |
| C 17 | 15% |
| C 18 | 1% |

EXAMPLE 1

A mixture of chlorine and sulfur dioxide gas is introduced in a volume ratio of 1:1:2 into chloroparaffin having a chlorine content of 19.4% at temperatures between 50° and 55° C. over a period of 3 h, with simultaneous exposure to ultraviolet light, until the hydrolyzable chlorine content is about 4%.

400 parts of the sulfochloride, expelled with nitrogen, is gradually introduced with stirring into a mixture cooled to −40° C. of 300 ml liquid ammonia and 200 ml petroleum ether. Stirring is then continued for 2 h with further cooling to −40° C. After heating to room temperature, the separated ammonium chloride is filtered off and the petroleum ether is separated from the reaction product by distillation.

The resulting yellow-brown, slightly turbid oil contains 19.4% chlorine 3.65% sulfur 1.56% nitrogen and consists of about 52% chloroparaffin sulfonamide and chloroparaffin sulfimide, and about 48% chloroparaffin.

EXAMPLE 2

Analogously to Example 1, a sulfochloride containing about 6% hydrolyzable chlorine is prepared from a chloroparaffin having a chlorine content of 19.4%.

After being expelled with nitrogen, the sulfochloride is transferred to an autoclave equipped with an agitator into which gaseous ammonia is introduced at so rapid a rate that the reaction temperature can be maintained at between 15° and 25° C. through external cooling of the reactor. On completion of the exothermic reaction, agitation is continued for 1 h at an ammonia pressure of 4 bars. The reaction product is agitated for ½ h at 70° C. with the same weight of water and then allowed to stand for separation of the phases. After separation of the aqueous salt layer, washing is repeated with one-half the weight of water, the pH value of the solution being adjusted to 5 by the addition of hydrochloric acid. After the aqueous layer has been decanted, a yellow-brown, turbid product is obtained which contains about 6.0% water,
about 0.1% ammonium chloride, and
about 93.0% of an organic substance
consisting of
about 74% chloroparaffin sulfonamide and chloroparaffin sulfimide,
about 20% chloroparaffin, and
about 6% chloroparaffin sulfonate and $NH_4$ salt.

EXAMPLE 3

Analogously to Example 1, a sulfochloride containing about 4.5% hydrolyzable chlorine is prepared from a chloroparaffin having a chlorine content of 19.4%.

847 parts of the chloroparaffin sulfochloride is introduced into 450 parts of a 10% aqueous ammonia solution with stirring. During the 3 h reaction time, the temperature rises to about 75° C. On completion of the reaction, a test is made to determine whether the solution is alkaline. After separation of the aqueous salt phase, there remains a yellow oil which at room temperature is clear and which contains about 14% water
about 3% ammonium chloride and
about 83% of an organic substance composed of
about 23% chloroparaffin sulfonamide and chloroparaffin sulfimide,
about 35% chloroparaffin sulfonate and $NH_4$ salt, and
about 42% chloroparaffin.

EXAMPLE 4

In a sulfochlorination vessel, liquid n-paraffin having an average molecular weight of 213 is treated for 90 min. at temperatures between 50° and 55° C. with a gaseous mixture of chlorine and sulfur dioxide with a volume ratio of 1:1.2, with simultaneous exposure to UV light, until the hydrolyzable chlorine content is about 6%. The reaction is exothermic and appropriate cooling must be provided. On completion of the reaction, the reaction product is expelled with nitrogen.

The sulfochloride is charged to an autoclave equipped with an agitator into which gaseous ammonia is introduced at a rate permitting the reaction temperature to be maintained at between 15° and 20° C. by additional external cooling. On completion of the exothermic reaction, agitation is continued for 1 h at about 20° C. and an ammonia pressure of 3 bars. After the ammonia excess pressure has been relieved, the reaction product is mixed with one-fourth of its weight of water and agitated for ½ h at 60° C. and then allowed to stand at 60° C. for separation of the phases. After the aqueous salt layer has been decanted, a yellow, slightly turbid oil is obtained which contains 2.5% water,
0.5% ammonium chloride, and
97.0% of an organic substance
consisting of about
45% paraffin sulfonamide and paraffin sulfimide,
3% paraffin sulfonate and $NH_4$ salt, and
52% neutral oil.

The use made of the products will now be described in the examples which follow, all amounts being based on the shaved weight of the leather, and AS standing for active substance.

EXAMPLE 5

| | | | |
|---|---|---|---|
| Stock: | Chrome-tanned cowhide<br>Shaved thickness: About 1.3 mm | | |
| Rinsing | | 35° C. | 10 min. |
| Neutralization | | | |
| 200.0% | water | | |
| 2.0% | Tanigan PC* | undissolved | 30 min. |
| 1.0% | sodium bicarbonate | | |
| | pH of liquor about 7.0<br>Leather cross section against<br>Bromocresol Green: Blue | | |
| Rinsing | | to 60° C. | |
| Dyeing | | | |
| 100.0% | water | 60° C. | |
| 1.0% | Supranol Fast Brown 5R<br>(an acid-substantive dye)<br>Colour Index Acid Orange 51<br>diluted 1:20, two portions<br>every 10 min. | | 45 min. |
| Fatting in the dye bath: | | | |
| Feed: | | | |
| (a) 8.5% | of a sulfated neatsfoot-sperm oil mixture,<br>Na salts,<br>ratio about 2:1<br>AS about 85%<br>org. bound $SO_3$ about 5.5% | | 45 min. |
| (b) 8.5% | sulfated neatsfoot-sperm oil mixture as under (a) | | |
| 2.0% | product according to Example 2 | | 45 min. |
| Total fat: | 9.1%, of which sulfonamide 1.4%<br>= about 15.4% sulfonamide<br>about 84.6% residual fat | | |
| (c) 8.5% | sulfated neatsfoot-sperm oil mixture as under (a) | | |
| 2.2% | product according to Example 4 | | 45 min. |
| Total fat: | 9.3%, of which sulfonamide 0.97%<br>= about 10.4% sulfonamide<br>about 89.6% residual fat | | |
| *Fast synthetic neutralization tanning agent of Bayer AG | | | |
| Feed in all fatting operations: | | | |
| 1.0% formic acid (85%), diluted 1:5 | | | 15 min. |
| All leathers hung on racks overnight to dry at about 30° C. - moisten, stake and stretch. | | | |

Determination of lightfastness in conformity with DIN 54 004 Lightfastness:

(a) About 3
(b) About 4
(c) About 3.5

The concurrent use of chloroalkane sulfonamide in fatting resulted in an increase of the lightfastness from 3 to 4, which is particularly difficult to achieve in this application. The concurrent use of the alkane sulfonamide described also produced a half-step improvement in lightfastness.

EXAMPLE 6

Preliminary operations up to the dyeing operation as in Example 5.

| | | |
|---|---|---|
| Dyeing | | |
| 100.0% water | 60° C. | |
| 1.0% Baygenal Olive LC2G 150% (1:2 metal-complex dye) Colour Index Acid Green 99 diluted 1:20, two portions every 10 min. | | 45 min. |
| Fatting in the dye bath: | | |
| Feed: | | |
| (a) 8.5% of a sulfated neatsfoot oil-sperm oil mixture, Na salts, ratio about 2:1 AS about 85% org. bound $SO_3$ about 5.5% | | 45 min. |
| (b) 8.5% sulfated neatsfoot oil-sperm oil mixture as under (a) | | |
| 2.0% product according to Example 2 | | 45 min. |
| Total fat: 9.1%, of which sulfonamide 1.4% = about 15.4% sulfonamide about 84.6% residual fat | | |
| (c) 8.5% sulfated neatsfoot oil-sperm oil mixture as under (a) | | |
| 2.2% product according to Example 4 | | 45 min. |
| Total fat: 9.3%, of which sulfonamide 0.97% = about 10.4% amide about 89.6% residual fat | | |
| Feed in all fatting operations: | | |
| 1.0% formic acid (85%), diluted 1:5 | | 15 min. |
| All leathers hung on racks overnight to dry at about 30° C. - moistening, staking and stretching. | | |

Determination of lightfastness in conformity with DIN 54 004: Lightfastness:

(a) About 2
(b) About 4
(c) About 3

Particularly impressive in this dyeing operation is the increase in lightfastness from 2 to 4 produced by the concurrent use of chloroalkane sulfonamide. The alkane sulfonamide also resulted in a decided increase in lightfastness from 2 to 3.

EXAMPLE 7

Preliminary operations up to the dyeing operation as in Example 5.

| | | |
|---|---|---|
| Dyeing | | |
| 100.0% water | 60° C. | |
| 1.0% Baygenal Red CB (an acid-substantive dye) Colour Index Acid Red 154 diluted 1:20, two portions every 10 min. | | 45 min. |
| Fatting in the dye bath: | | |
| Feed: | | |
| (a) 8.5% of a sulfated neatsfoot oil-sperm oil mixture, Na salts ratio about 2:1 AS about 85% org. bound $SO_3$ about 5.5% | | |
| (b) 8.5% sulfated neatsfoot oil-sperm oil mixture as under (a) | | |
| 0.5% product according to Example 1 | | 45 min. |
| Total fat: 7.7%, of which sulfonamide 0.25% = about 3.3% sulfonamide about 96.7% residual fat | | |
| (c) 8.5% sulfated neatsfoot oil-sperm oil mixture as under (a) | | |
| 0.5% product according to Example 4 | | 45 min. |
| Total fat: 7.7%, of which sulfonamide 0.22% = about 2.8% sulfonamide about 97.2% residual fat | | |
| Feed in all fatting operations: | | |
| 1.0% formic acid (85%), diluted 1:5 | | 15 min. |

-continued

| | | |
|---|---|---|
| All leathers hung on racks overnight to dry at about 30° C. moistening, staking, stretching. | | |

Determination of lightfastness in conformity with DIN 54 004: Lightfastness:

(a) About 2
(b) About 3
(c) About 3

Even small amounts of the chloroalkaneamide or alkaneamide used produce a decided increase in the lightfastness of the coloration.

EXAMPLE 8

Preliminary operations up to the dyeing operation as in Example 5.

| | | |
|---|---|---|
| Dyeing | | |
| 100.0% water | 60° C. | |
| 1.0% Baygenal Brown LC5G (a 1:2 metal-complex dye) Colour Index Acid Brown 324 diluted 1:20, two portions every 10 min. | | 45 min. |
| Fatting in the dye bath: | | |
| Feed | | |
| (a) 8.5% sulfated sperm oil, Na salt AS about 82% Org. bound $SO_3$ about 6% | | 45 min. |
| (b) 8.5% sulfated sperm oil, as under (a) | | |
| 1.5% product according to Example 2 | | 45 min. |
| Total fat: 8.4%, of which sulfonamide 1.0% = 11.9% sulfonamide, rest fat | | |
| (c) 8.5% sulfated sperm oil as under (a) | | |
| 1.5% product according to Example 4 | | 45 min. |
| Total fat: 8.5%, of which sulfonamide 0.7% = about 8.23% sulfonamide, rest fat | | |
| Feed in all fatting operations: | | |
| 1.0% formic acid (85%), diluted 1:5 | | 15 min. |
| All leathers hung on racks overnight for drying at about 30° C. - moistening, staking, and stretching. | | |

Determination of lightfastness in conformity with DIN 54 004: Lightfastness:

(a) About 2 to 3
(b) About 3 to 4
(c) About 3.5

The concurrent use of a chloroalkane sulfonamide in fatting with a sperm oil regarded as having good stability to light results in an increase in the lightfastness of the coloration by 1 step, and the concurrent use of an alkane sulfonamide by about half a step.

EXAMPLE 9

Preliminary steps up to the dyeing operation as in Example 5.

| | | |
|---|---|---|
| Dyeing | | |
| 100.0% water | 60° C. | |
| 1.0% Baygenal Olive LC2G 150% (a 1:2 metal-complex dye) Colour Index Acid Green 99 diluted 1:20, two portions every 10 min. | | 45 min. |
| Fatting in the dye bath: | | |
| Feed: | | |
| (a) 10.0% sulfated fish oil, $NH_4$ salt AS about 55% Org. bound $SO_3$ about 2.7% | | 45 min. |
| (b) 10.0% sulfated fish oil, as under (a) | | |
| 2.0% product according to Example 1 | | 45 min. |
| Total fat: 7.5%, of which sulfonamide 1.0% = about 13.3% sulfonamide about 86.7% residual fat | | |
| (c) 10.0% sulfated fish oil as under (a) | | |

-continued 2.0% product according to Example 4 — 45 min.
Total fat: 7.44%, of which sulfonamide 0.88%
= about 11.8% sulfonamide
about 88.2% residual fat
1.0% formic acid (85%), diluted 1:5
All leathers hung on racks overnight for drying at about 30° C. - moistening, staking, and stretching.

Determination of lightfastness in conformity with DIN 54 004: Lightfastness:

(a) About 2
(b) About 3 to 4
(c) About 3

The lightfastness of the dyed leather is substantially increased also in fatting with "yellowing" fatting agents such as sulfated fish oil.

EXAMPLE 10

Preliminary steps up to the dyeing operation as in Example 5.

Dyeing
100.0% water — 60° C.
1.0% Baygenal Brown LC5G — 45 min.
(a 1:2 metal-complex dye)
Colour Index Acid Brown 324
diluted 1:20, two portions every 10 min.
Fatting in the dye bath:
Fatting with a fatting agent for soft leathers based on:
Feed:
(a) 8.5% of a mixture of
40.0% sulfated fish oil as in Example 9 (a)
45.0% mineral oil
15.0% chloroalkane sulfonate, $NH_4$ salt — 45 min.
AS about 90%
Org. bound $SO_3$ about 2.0%, based on total mixture.
(b) 8.0% fatting agent as under (a)
1.0% product according to Example 2 — 45 min.
Total fat: 7.3%, of which sulfonamide 0.7%
= about 9.6% amide
about 90.4% residual fat
(c) 8.0% fatting agent, as under (a)
1.0% product according to Example 4 — 45 min.
Total fat: 7.4%, of which sulfonamide 0.44%
= about 6% amide
about 94% residual fat
Feed in all fatting operations:
1.0% formic acid (85%), diluted 1:5 — 15 min.
All leathers hung on racks overnight for drying at about 30° C. - moistening, staking, and stretching.

Determination of lightfastness in conformity with DIN 54 004:

Lightfastness:

(a) About 3
(b) About 4 to 5
(c) About 4

The improvement in lightfastness due to the concurrent use of chloroalkane or alkane sulfonamides is substantial. This is all the more remarkable as the fatting agent contains substantial amounts of fish oil.

Finally, fatting agents based on alkane sulfonates and chloroalkane sulfonates, which are regarded as highly stable to light, were included in the test series.

EXAMPLE 11

Preliminary steps up to the dyeing operation as in Example 5.

Dyeing:

-continued 100.0% water — 60° C.
1.0% Supranol Fast Brown 5R — 45 min.
(an acid-substantive dye)
Colour Index Acid Orange 51
diluted 1:20, two portions every 10 min.
Fatting in the dye bath:
Feed:
(a) 11.0% alkane sulfonate, Na salt — 45 min.
Chain length: $C_{20}$ to $C_{30}$
AS about 60%
Org. bound $SO_3$ about 6%
(b) 11.0% alkane sulfonate, as under (a)
2.0% product according to Example 2 — 45 min.
Total fat: 8.56%, of which sulfonamide 1.4%
= 16.4% sulfonamide
83.6% residual fat
Feed in all fatting operations:
1.8% formic acid (85%), diluted 1:5 — 15 min.
All leathers hung on racks overnight for drying at about 30° C. - moistening, staking, and stretching.

Determination of lightfastness in conformity with DIN 54 004: Lightfastness:

(a) About 3
(b) About 4

In this case, too, the concurrent use of chloroalkane sulfonamide resulted in a substantial improvement in the lightfastness of the coloration.

EXAMPLE 12

Preliminary steps up to the dyeing operation as in Example 5.

Dyeing:
100.0% water — 60° C.
1.0% Baygenal Olive LC2G 150% — 45 min.
(a 1:2 metal-complex dye)
Colour Index Acid Green 99
diluted 1:20, two portions every 10 min.
Fatting in the dye bath:
Feed:
(a) 11.0% alkane sulfonate, Na salt — 45 min.
Chain length: $C_{20}$ to $C_{30}$
AS about 60%
org. bound $SO_3$ about 6%
(b) 11.0% alkane sulfonate, as under (a)
2.0% product according to Example 2 — 45 min.
Total fat: 8.5%, of which 1.4% sulfonamide
= about 16.5% sulfonamide
about 83.5% residual fat
Feed in all fatting operations:
1.0% formic acid (85%), diluted 1:5 — 15 min.
All leathers hung on racks overnight to dry at about 30° C. - moistening, staking, and stretching.

Determination of lightfastness in conformity with DIN 54 004: Lightfastness:

(a) About 3
(b) About 4

In this dyeing operation, too, the chloroalkane sulfonamide produced a substantial increase in lightfastness, especially considering that the jump from step 3 to step 4 is big.

EXAMPLE 13

Preliminary steps up to the dyeing operation as in Example 5.

Dyeing:
100.0% water — 60° C.
1.0% Baygenal Brown LC5G — 45 min.
(a 1:2 metal-complex dye)

-continued

Colour Index Acid Brown 324
diluted 1:20, 2 portions every 10 min.
Fatting in the dye bath:
Feed:
(a) 7.5% chloroalkane sulfonate, Na salt — 45 min.
Chain length: $C_{16}$ to $C_{22}$
AS about 90%
Chlorine content of alkane, about 20 wt. %
Org. bound $SO_3$ about 10%
(b) 7.5% chloroalkane sulfonate, as under (a)
3.0% product according to Example 3 — 45 min.
Total fat: 9.25%, of which 0.6% sulfonamide
= about 6.5% sulfonamide
about 93.5% residual fat
Feed in all fatting operations:
1.0% formic acid (85%), diluted 1:5
All leathers hung on racks overnight to dry at about 30° C. - moistening, staking, and stretching.

Determination of lightfastness in conformity with DIN 54 004: Lightfastness:
(a) About 4
(b) About 5

In this dyeing operation, too, the concurrent use of chloroalkane sulfonamide resulted in an increase in lightfastness.

EXAMPLE 14

Preliminary steps up to the dyeing operation as in Example 5.

Dyeing
100.0% water — 60° C.
1.0% Baygenal Olive LC2G 150% — 45 min.
(1:2 metal-complex dye)
Colour Index Acid Green 99
diluted 1:20, 2 portions every 10 min.
Fatting in the dye bath:
Feed:
(a) 10.0% sulfated fish oil, $Na_4$ salt — 45 min.
AS about 55%
Org. bound $SO_3$ about 2.7%
(b) 10.0% sulfated fish oil, as under (a)
Fresh liquor: 100% — 60° C. — 45 min.
1.0% chloroalkane sulfonamide
according to Example 1 plus
2.0% nonylphenol hydroxyethylate × 9
Total fat: 8.5%, of which sulfonamide 0.5%
= about 6% sulfonamide
about 94% residual fat
(a) 10.0% sulfated fish oil, as under (a)
Fresh liquor: 100% — 60° C. — 20 min.
1.0% alkane sulfonamide according
to Example 4
Total fat: 6.5%, of which sulfonamide 0.44%
= about 7% sulfonamide
about 93% residual fat
Feed in all fatting operations:
1.0% formic acid (85%), diluted 1:5 — 15 min.
All leathers hung on racks overnight to dry at about 30° C. - moistening, staking, and stretching.

Determination of lightfastness in conformity with DIN 54 004: Lightfastness:
(a) About 2
(b) About 3 to 4
(c) About 3 to 4

This example illustrates the treatment with the additives in accordance with the invention which improve lightfastness in a separate stage following fatting, in other words, in a separate liquor.

EXAMPLE 15

Preliminary steps up to the dyeing operation as in Example 5.

Dyeing
100.0% water — 60° C.
1.0% Baygenal Olive LC2G 150% — 45 min.
(a 1:2 metal-complex dye)
Colour Index Acid Green 99
diluted 1:20, 2 portions every 10 min.
Fatting in the dye bath:
Feed:
(a) 10.0% sulfated fish oil, $NH_4$ salt — 45 min.
AS about 55%
Org. bound $SO_3$ about 2.7%
(b) 10.0% sulfated fish oil, as under (a)
2.0% product according to Example 1 — 45 min.
Total fat: 7.5%, of which 0.5% sulfonamide
= about 6.7% sulfonamide
about 93.3% residual fat
(c) 10.0% sulfated fish oil, as under (a)
1.0% product according to Example 1
1.0% product according to Example 4
Total fat: 7.5%, of which 0.94% sulfonamide
= about 12.5% sulfonamide
about 87.5% residual fat
Feed in all fatting operations:
1.0% formic acid (85%), diluted 1:5
All leathers hung on racks overnight to dry at about 30° C. - moistening, staking, and stretching.

Determination of lightfastness in conformity with DIN 54 004: Lightfastness:
(a) About 2
(b) About 3 to 4
(C) About 3 to 4

This example illustrates the use of a combination of alkane sulfonamide and chloroalkane sulfonamide in the ratio of 1:1.

EXAMPLE 16

Preliminary steps up to the dyeing operation as in Example 5.

(a) Dyeing:
100.0% water — 60° C.
1.0% Baygenal Brown LC5G
(a 1:2 metal-complex dye)
Colour Index Acid Brown 324
diluted 1:20, 2 portions every 10 min. — 5 min.
Rinsing — 60° C.
100.0% water
8.5% of a sulfated neatsfoot oil-
sperm oil mixture, Na salts — 45 min.
as described in Example 6
Feed:
1.0% formic acid (85%), dilute 1:5 — 15 min.
(b) Dyeing:
As under (a)
Pretreatment in dye bath:
0,5% chloroalkane sulfonamide according
to Example 1 plus
1.0% nonylphenol hydroxyethylate × 9 — 15 min.
Total fat: 8.7%, of which 0,25% sulfonamide
= about 3% sulfonamide
about 97% residual fat
Rinsing — 60° C. — 5 min.
Fatting:
100.0% water — 60° C.
8.5% of a sulfated neatsfoot oil-
sperm oil mixture, Na salts — 45 min.
as described in Example 6
Feed:
1.0% formic acid (85%), diluted 1:5 — 5 min.
All leathers hung on racks overnight to dry at about 30° C. -

-continued moistening, staking, and stretching.

Determination of lightfastness in conformity with DIN 54 004: Lightfastness:

(a) About 3

(b) About 4.5

The lightfastness of the coloration is substantially improved when the leather is made to undergo a pretreatment with chloroalkane sulfonamide.

It will be appreciated that the instant specification, examples and claims are set forth by way of illustration and not limitation and that various changes and modifications may be made without departing from the spirit and scope of the present invention.

What is claimed is:

1. In the dyeing of leather, the improvement which comprises treating the leather before, during or after fatting with at least one of an alkane sulfonamide and a chloroalkane sulfonamide, the sulfonamide being employed in about 0.5 to 40% by weight of total fat and in about 0.1 to 8% of the shaved weight of the leather, whereby the lightfastness of the dyed leather is improved.

2. A process according to claim 1, wherein the sulfonamide is present in such proportion relative to the fatliquoring agent that the mixture is soluble in water or at least forms a stable emulsion in water.

3. A process according to claim 2, wherein the sulfonamide is present in about 0.5 to 25% by weight of total fat and in about 0.5 to 2.5% of the shaved weight of the leather, the alkane moiety being a straight chain of about 12 to 28 carbon atoms and the chlorine content of the sulfonamide, when present, being about 15 to 30% by weight.

4. A process according to claim 1, wherein the alkane moiety has about 10 to 35 carbon atoms and the chlorine content of the sulfonamide, when present, is about 10 to 40% by weight.

5. A process according to claim 1, wherein the alkane moiety is a straight chain of about 12 to 28 carbon atoms and the chlorine content of the sulfonamide, when present, is about 15 to 30% by weight.

6. A process according to claim 1, wherein the sulfonamide is employed is about 0.3 to 6% of the shaved weight of the leather.

7. A process according to claim 1, wherein the sulfonamide is employed in about 0.5 to 2.5% of the shaved weight of the leather.

8. A process according to claim 1, wherein the treatment is effected simultaneously with fatliquoring of the leather.

9. A process according to claim 1, wherein the sulfonamide is present in about 0.8 to 25% by weight of total fat but in at least about 0.1% of the shaved weight of the leather.

* * * * *